US009548176B2

(12) United States Patent
McEvilly et al.

(10) Patent No.: US 9,548,176 B2
(45) Date of Patent: Jan. 17, 2017

(54) FUSE TERMINAL FOR USE WITH AN ELECTRICAL FUSE ASSEMBLY

(71) Applicant: Lear Corporation, Southfield, MI (US)

(72) Inventors: Paul McEvilly, Farmington Hills, MI (US); Allen Leo Mott, Livonia, MI (US); Daniel Jilg, Novi, MI (US); Aric Henderson Anglin, Rives Junction, MI (US)

(73) Assignee: LEAR CORPORATION, Southfield, MI (US)

( * ) Notice: Subject to any disclaimer, the term of this patent is extended or adjusted under 35 U.S.C. 154(b) by 0 days.

(21) Appl. No.: 14/795,198

(22) Filed: Jul. 9, 2015

(65) Prior Publication Data

US 2016/0028195 A1 Jan. 28, 2016

Related U.S. Application Data

(60) Provisional application No. 62/027,315, filed on Jul. 22, 2014.

(51) Int. Cl.

| | |
|---|---|
| ***H01R 4/48*** | (2006.01) |
| ***H01H 85/22*** | (2006.01) |
| ***H01H 85/20*** | (2006.01) |
| ***H01H 85/041*** | (2006.01) |
| ***H01H 85/153*** | (2006.01) |
| ***H01H 85/157*** | (2006.01) |
| *H01R 13/04* | (2006.01) |
| *H01R 13/11* | (2006.01) |
| *H01R 31/06* | (2006.01) |

(52) U.S. Cl.

CPC ..... *H01H 85/22* (2013.01); *H01H 85/0411* (2013.01); *H01H 85/0418* (2013.01); *H01H 85/153* (2013.01); *H01H 85/157* (2013.01); *H01H 85/202* (2013.01); *H01R 4/48* (2013.01); *H01R 13/04* (2013.01); *H01R 13/111* (2013.01); *H01R 31/06* (2013.01); *H01R 2201/26* (2013.01)

(58) Field of Classification Search

CPC ..... H01H 85/202
USPC ..... 439/830, 890, 620.26, 250
See application file for complete search history.

(56) References Cited

U.S. PATENT DOCUMENTS 4,023,884 A 5/1977 Morlan
4,052,688 A * 10/1977 DeNigris ..... H01H 85/306 337/187

(Continued)

FOREIGN PATENT DOCUMENTS

DE 102008006662 A1 * 7/2009 ..... H01H 85/202

OTHER PUBLICATIONS

"Blade Terminal & Special Purpose Fuses" LVSP Series Surge Fuse, Littelfuse, pp. 463-464, accessed at www.littelfuse.com (admitted prior art).

(Continued)

*Primary Examiner* — Tho D Ta
(74) *Attorney, Agent, or Firm* — MacMillan, Sobanski & Todd, LLC

(57) ABSTRACT

A fuse terminal includes a central body portion. A first arm extends from the central body portion and defines an arm space that is located on a fuse side of the central body portion. A connector portion also extends from the central body portion and includes a leg that extends on the fuse side of the central body portion.

20 Claims, 5 Drawing Sheets

(56) References Cited

U.S. PATENT DOCUMENTS

| | | | | |
|---|---|---|---|---|
| 4,432,594 | A * | 2/1984 | Daggett | H01H 85/205 439/698 |
| 4,648,674 | A * | 3/1987 | Sanchez, Jr. | H01H 85/201 439/395 |
| 4,762,510 | A | 8/1988 | Schaefer | |
| 4,768,968 | A | 9/1988 | Daggett et al. | |
| 4,801,278 | A | 1/1989 | Sappington | |
| 5,154,640 | A * | 10/1992 | Chen | H01H 85/205 439/620.29 |
| 7,553,175 | B1 * | 6/2009 | Benson | H02B 1/056 361/637 |
| 7,564,337 | B2 * | 7/2009 | Whitney | H01H 85/0418 337/187 |
| 8,979,600 | B2 * | 3/2015 | von zur Muehlen | H01H 85/48 439/833 |
| 2003/0049955 | A1 * | 3/2003 | Schilling | H01H 85/202 439/83 |
| 2010/0090792 | A1 | 4/2010 | Whitney et al. | |

OTHER PUBLICATIONS

"Fast-acting fuses for direct mounting on printed circuit boards", PCF Fast Acting PC Mount Fuses, Mersen, pp. C11-C14 (admitted prior art).

* cited by examiner

FUSE TERMINAL FOR USE WITH AN ELECTRICAL FUSE ASSEMBLY

CROSS-REFERENCE TO RELATED APPLICATIONS

This application claims the benefit of U.S. Provisional Application No. 62/027,315, filed Jul. 22, 2014, the disclosure of which is incorporated herein by reference.

BACKGROUND OF THE INVENTION

This invention relates in general to electrical fuses, such as are commonly used in vehicular electrical systems. In particular, this invention relates to an improved structure for a fuse terminal for use in an electrical fuse assembly that has a reduced package size.

Many electrical circuits are provided with electrical fuses, which are well known devices that provide protection from excessive magnitudes of electrical current that may otherwise occur therein. One typical type of fuse includes an elongated central portion that extends between a first end portion and a second end portion. The central portion of the fuse includes an internal member, typically a wire or a relatively thin strip of material, having a first end and a second end that are respectively electrically connected to the first end portion and the second end portion. The internal member, the first end portion, and the second end portion are all formed from an electrically conductive material. As is well known in the art, when the amount of an electrical current that is passed through the fuse exceeds a predetermined magnitude, the wire or relatively thin strip of material becomes heated and melts, thereby interrupting the flow of electrical current therethrough and preventing damage from occurring to the electrical circuit.

Electrical circuits are commonly provided in many types of vehicles to control the operation of various electrical devices and systems therein, and most of such vehicular electrical circuits are provided with fuses as described above. To facilitate the installation and removal of fuses in such vehicular electrical circuits, the fuse is often embodied as a fuse terminal assembly that includes not only the fuse itself, but also a first fuse terminal and a second fuse terminal that are respectively connected to the first end portion and the second end portion of the fuse. The fuse terminals include respective connector portions that are adapted to connect the first end portion and the second end portion of the fuse to respective female receptacles provided in the vehicular electrical circuit.

A variety of fuse terminal assembly structures are known in the art and function effectively. However, it is well known that the amount of physical space in many vehicular electrical circuits is often quite limited. Thus, it would be desirable to provide an improved structure for a fuse terminal for use with an electrical fuse terminal assembly that has a reduced package size.

SUMMARY OF THE INVENTION

This invention relates to a fuse terminal for use in a fuse assembly. The fuse terminal includes a central body portion. A first arm extends from the central body portion and defines an arm space that is located on a fuse side of the central body portion. A connector portion also extends from the central body portion and includes a leg that extends on the fuse side of the central body portion.

This invention further relates to a fuse terminal assembly. The fuse terminal assembly includes a first end portion, a second end portion, and a central portion extending between the first end portion and the second end portion along a fuse axis. The fuse terminal assembly also includes a fuse terminal that has a central body portion that extends along a terminal axis that is generally parallel to the fuse axis. A first arm and a second arm extend from the central body portion and define an arm space therebetween that is located on a fuse side of the central body portion. The first arm and the second arm engage the first end portion of the fuse. A connector portion also extends from the central body portion and includes a leg that extends on the fuse side of the central body portion.

Various aspects of this invention will become apparent to those skilled in the art from the following detailed description of the preferred embodiment, when read in light of the accompanying drawings.

DETAILED DESCRIPTION OF THE PREFERRED EMBODIMENT

Figure 1:
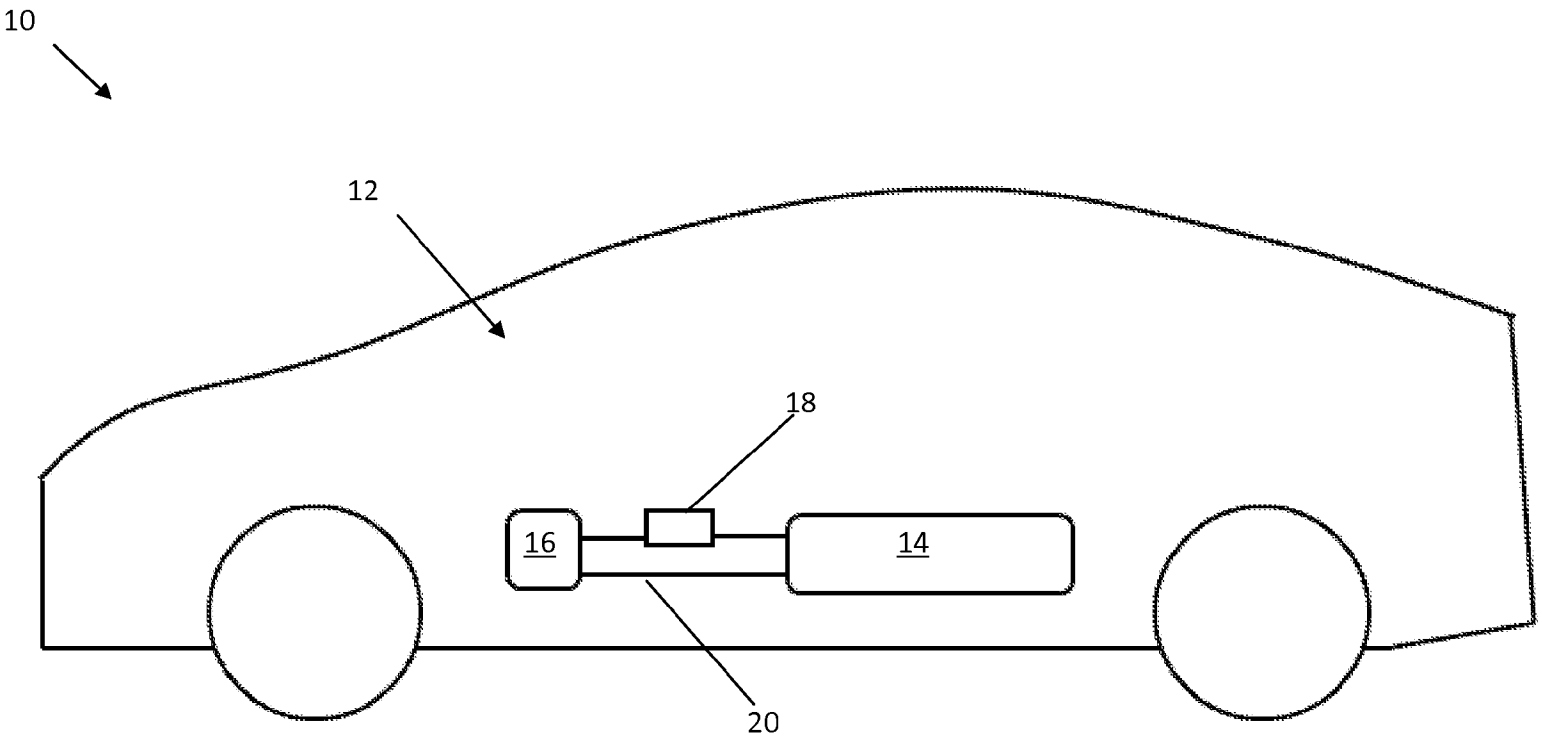
FIG. 1 is a schematic view of a vehicle that includes a vehicular electrical circuit.

Referring now to the drawings, there is shown in FIG. 1 a schematic view of a vehicle, indicated generally at 10. The illustrated vehicle 10 is a passenger car, but may be any desired vehicle. The vehicle 10 includes a vehicular electric system, indicated generally at 12. The vehicular electric system 12 includes a battery 14 that provides power to an electric component 16. The illustrated electric component 16 is shown schematically and may be any desired electric component on the vehicle 10. The vehicular electric system 12 also includes a fuse box 18 that is electrically connected in a circuit 20 between the battery 14 and the electric component 16.

Figure 2:
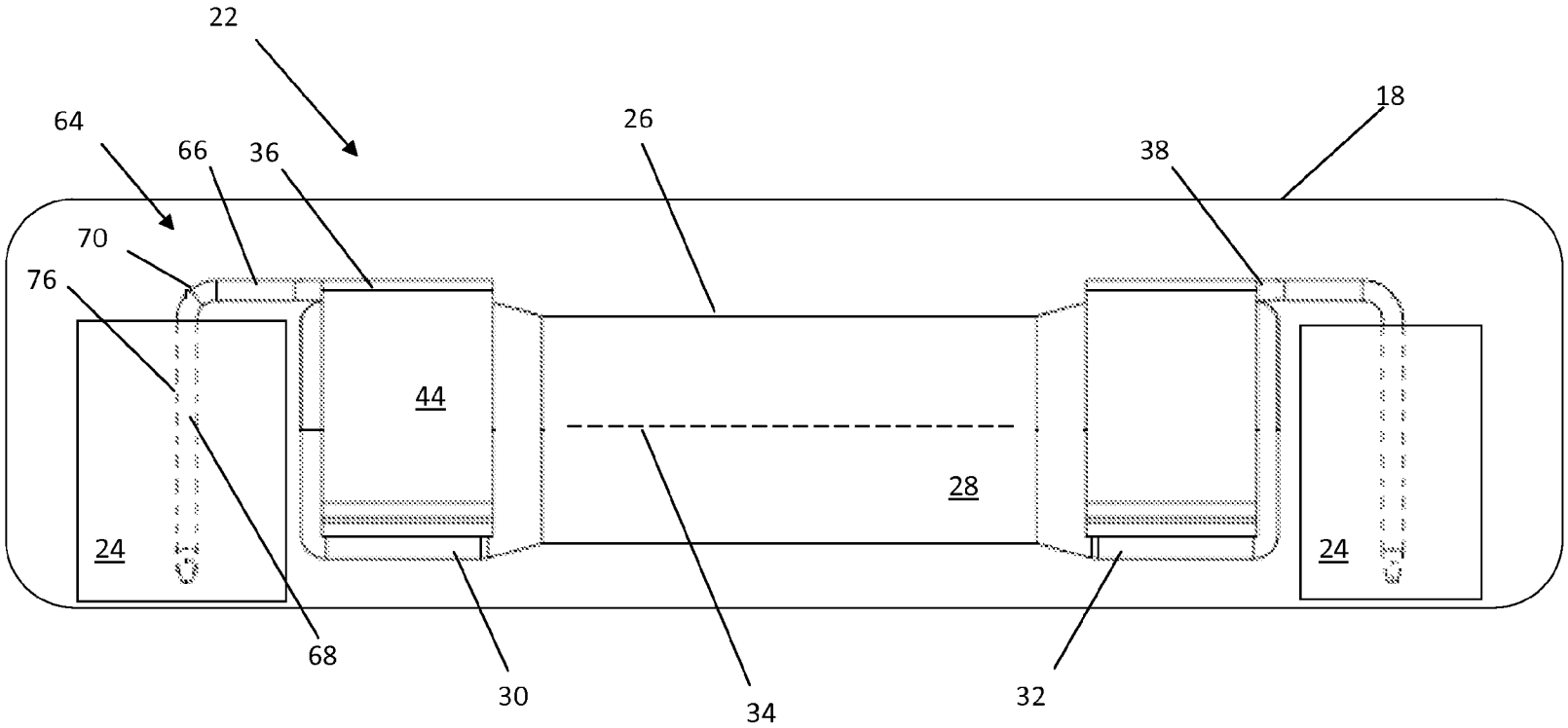
FIG. 2 is a side elevational view of a fuse assembly in accordance with this invention shown installed on a pair of conventional female receptacles of the vehicular electrical circuit illustrated in FIG. 1.

Referring to FIG. 2, there is illustrated a fuse assembly, indicated generally at 22, that is connected between two receiving terminals 24 of the fuse box 18. It should be appreciated that the illustrated fuse box 18 is only one, non-limiting example of a location where the fuse assembly 22 may be used. The fuse assembly 22 may be used in any desired device. The fuse assembly 22 includes a fuse 26. The illustrated fuse 26 is generally cylindrical in shape and includes a central portion 28, a first end portion 30, and a second end portion 32. As is known in the art, the central portion 28 includes an internal member (not shown) which can be a relatively thin strip of material that is connected to the first end portion 30 and the second end portion 32. The first end portion 30, the second end portion 32, and the internal member are all made of an electrically-conductive material. In the illustrated embodiment, the central portion 28 extends along a fuse axis 34 between the first end portion 30 and the second end portion 32. Also, the first and second end portions 30 and 32 have respective generally cylindrical outer surfaces and have a somewhat larger diameter than the central portion 28. However, the illustrated fuse 26 is representative only and may be replaced with any type of fuse having any size and shape.

The fuse assembly 22 also includes a first fuse terminal 36 and a second fuse terminal 38 that are supported on the first end portion 30 and second end portion 32, respectively. In the illustrated embodiment, the first fuse terminal 36 and the second fuse terminal 38 are identical, and only the first fuse terminal 36 will be described in detail. However, it should be appreciated that the first fuse terminal 36 and the second fuse terminal 38 may have different design details, if desired.

Figure 3:
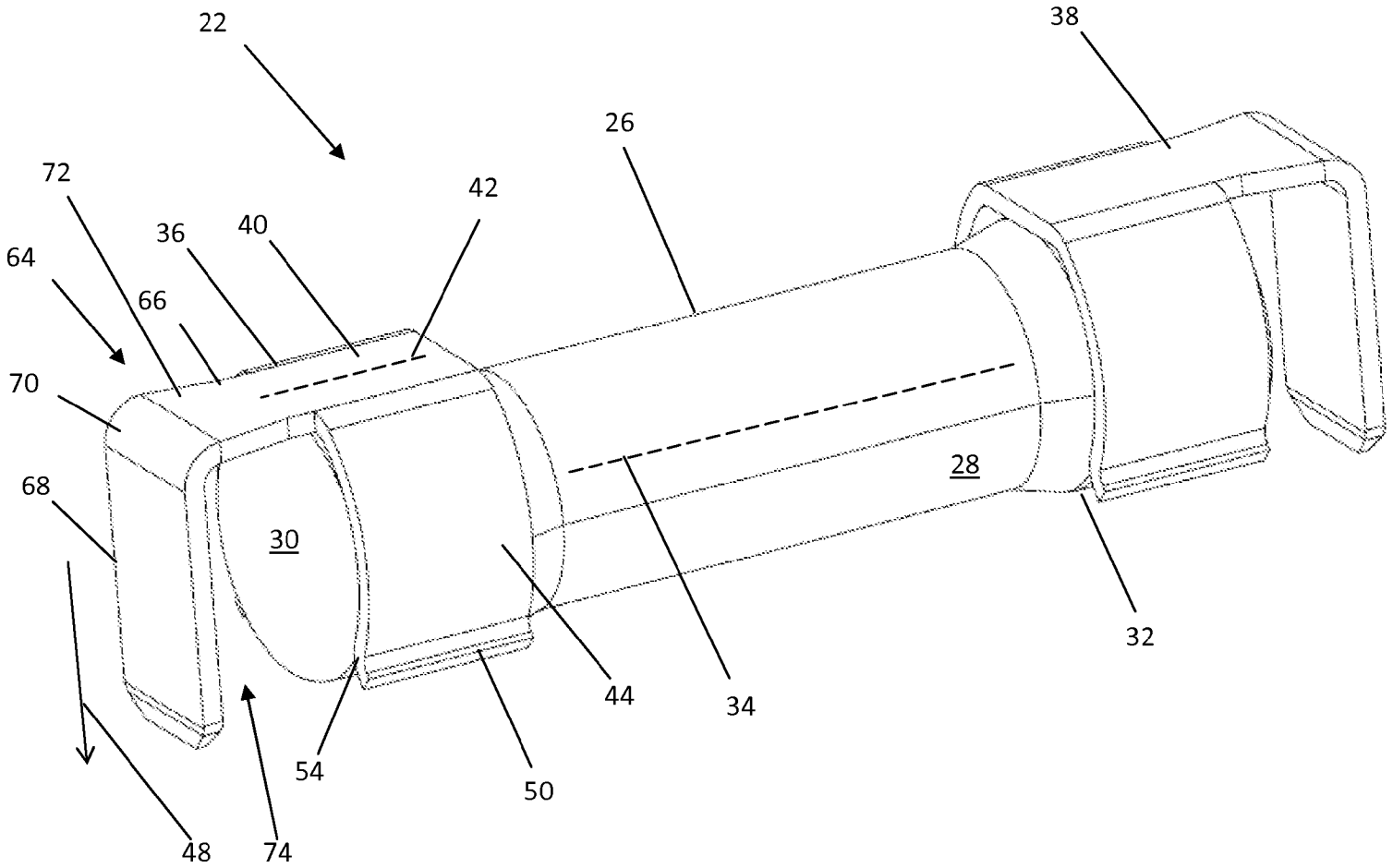
FIG. 3 is a perspective view of the fuse assembly illustrated in FIG. 2.
Figure 4:
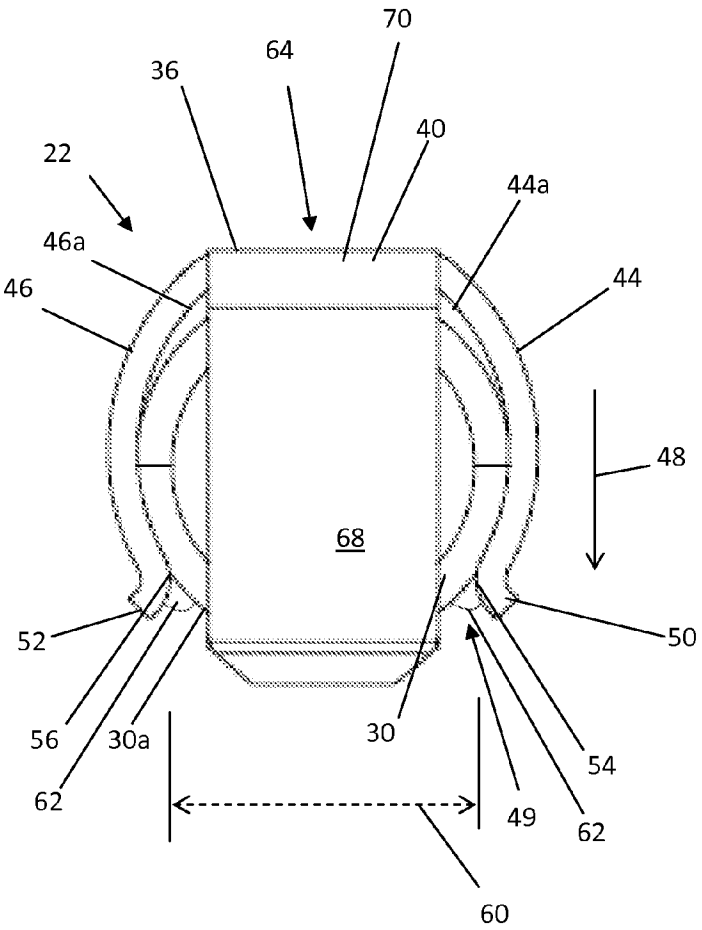
FIG. 4 is an end elevational view of the fuse assembly illustrated in FIGS. 2 and 3.
Figure 7:
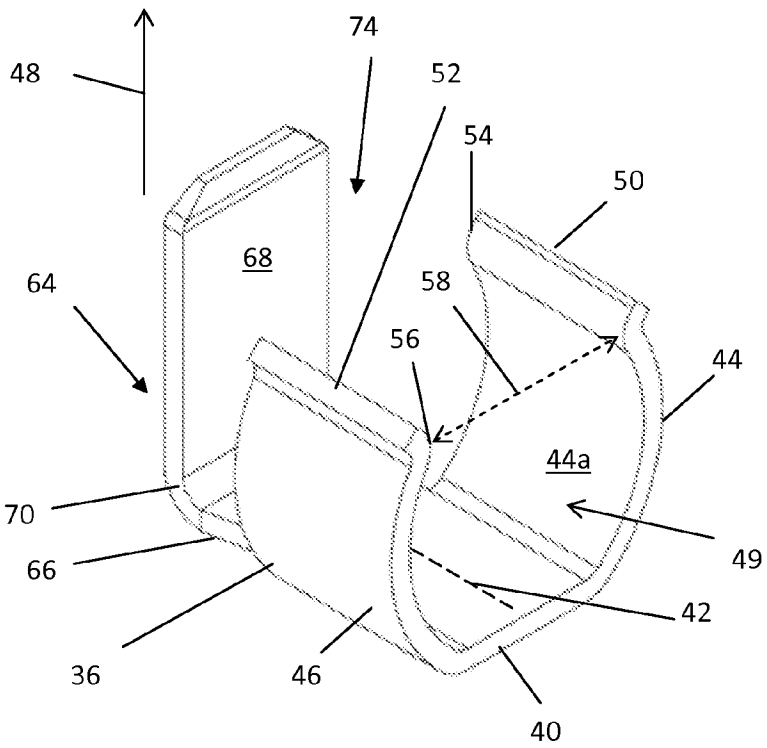
FIG. 7 is a perspective view, taken from below, of the fuse terminal illustrated in FIGS. 5 and 6.

The first fuse terminal 36 will be described in detail in reference to FIGS. 3 and 4, which show the first fuse terminal 36 installed on the first end portion 30 of the fuse 26, and also FIGS. 5 through 7, which illustrate various views of the first fuse terminal 36. The illustrated first fuse terminal 36 is made of a single piece of stamped copper, but may be made of any desired material and by any desired method. The first fuse terminal 36 includes a central body portion 40 that extends along a terminal axis 42. The illustrated central body portion 40 is generally planar, although it may have any desired shape. As best seen in FIG. 3, the terminal axis 42 is parallel to the fuse axis 34 when the fuse assembly 22 is assembled and the fuse 26 is located on a fuse side, indicated in the direction of the arrow 48, of the first fuse terminal 36. The illustrated first fuse terminal 36 includes a first arm 44 and a second arm 46 that extend from opposed edges of the central body portion 40. The illustrated first arm 44 and second arm 46 each have curved shapes, and are spaced apart from each other with an arm space 49 defined therebetween. The illustrated arm space 49 is located on the central body portion 40 on the fuse side 48 of the central body portion 40. The first arm 44 and the second arm 46 are adapted to engage the first end portion 30 of the fuse 26 in order to retain the first fuse terminal 36 on the fuse 26. As seen in FIG. 3, when the fuse assembly 22 is assembled, the first end portion 30 is located within the arm space 49. The first arm 44 and the second arm 46 have respective inner surfaces 44*a* and 46*a* which engage an outer surface 30*a* of the first end portion 30 when the fuse assembly 22 is assembled. As best seen in FIG. 4, the illustrated first arm 44 and second arm 46 have curved shapes with radii that are larger than the outer surface of the first end portion 30. However, the first arm 44 and the second arm 46 may have other desired shapes. Additionally, the first fuse terminal 36 may not include the second arm 46, if desired, and the arm space 49 may be defined by the first arm 44 alone, or by the central body portion 40 and the first arm 44.

The first arm 44 and the second arm 46 include optional outwardly-extending flanges 50 and 52 on distal ends thereof. The first arm 44 includes a first elbow 54 where the flange 50 extends from the distal end of the first arm 44. The second arm 46 includes a similar second elbow 56. As shown in FIG. 7, when the first fuse terminal 36 is not installed on the fuse 26, the first elbow 54 and the second elbow 56 are separated by an uninstalled distance 58. As shown in FIG. 4, when the first fuse terminal 36 is installed on the first end portion 30 of the fuse 26, the first elbow 54 and the second elbow 56 are separated by an installed distance 60. In the illustrated embodiment, the uninstalled distance 58 is less than the installed distance 60, and the first fuse terminal 36 is pre-stressed to engage the first end portion 30 so that the first fuse terminal 36 is frictionally retained on the first end portion 30. Additionally, in the illustrated embodiment, an optional fastener 62 is applied to retain the first fuse terminal 36 on the first end portion 30. In the illustrated embodiment, the fastener 62 is solder. However, the first fuse terminal 36 may be retained to the first end portion 30 by any desired fastener or method.

The first fuse terminal 36 also includes a connector portion, indicated generally at 64. The connector portion 64 is adapted to connect to one of the receiving terminals 24 of the fuse box 18. The illustrated connector portion 64 includes a first leg 66 that extends from the central body portion 40 parallel to the terminal axis 42. In the illustrated embodiment, the first leg 66 is a co-planar extension of the central body portion 40. The illustrated connector portion 64 also includes a second leg 68 that extends generally perpendicularly from the first leg 66 on the fuse side 48 of the central body portion 40. In the illustrated embodiment, the second leg 68 is created by providing a bend 70 in the connector portion 64 and the second leg 68. Referring to FIG. 6, a top view of the first fuse terminal 36 is shown. The illustrated connector portion 64 includes a width transition 72 between the second leg 68 and the central body portion 40 wherein the first leg 66 is wider where it meets the second leg 68 (at the bend 70) than it is where it meets the central body portion 40.

Figure 5:
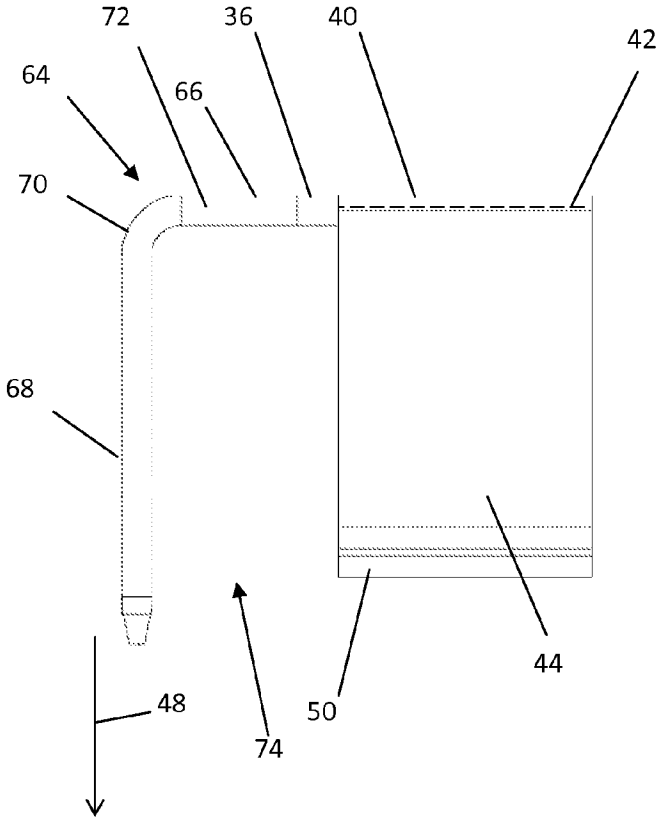
FIG. 5 is a side elevational view of a fuse terminal used in the fuse assembly illustrated in FIGS. 2, 3, and 4.
Figure 6:
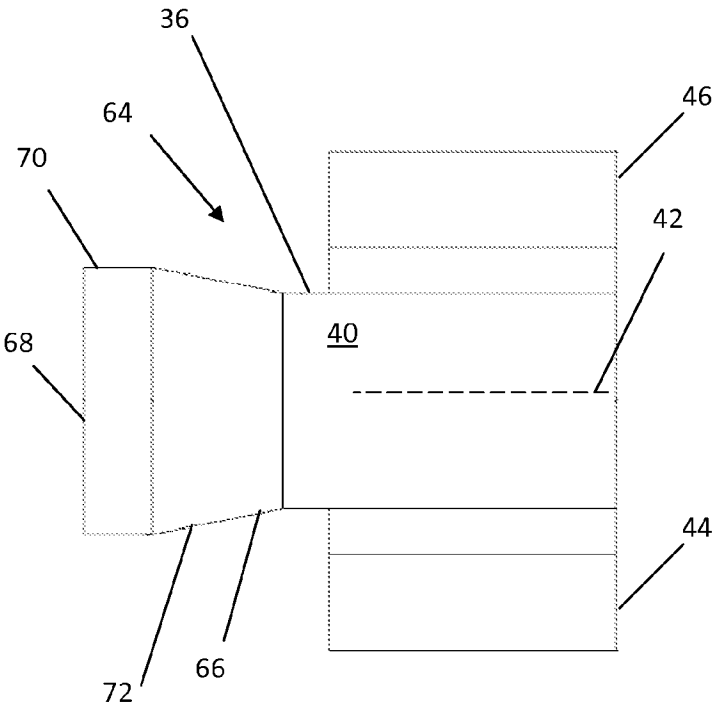
FIG. 6 is top plan view of the fuse terminal illustrated in FIG. 5.

As best seen in FIG. 5, the second leg 68 extends generally parallel to the first arm 44 and the second arm 46, and a terminal space, indicated generally at 74, is provided therebetween. The terminal space 74 may be of any desired size, but is preferably large enough to accommodate the insertion of the second leg 68 into one of the receiving terminals 24, as shown in FIG. 2. The illustrated receiving terminal 24 is a female terminal, and includes a slot 76 that is adapted to engage the second leg 68. The terminal space 74 is adapted to accommodate the receiving terminal 24 when the second leg 68 is inserted into the slot 76. As a result, an overall lateral dimension of the combined assembly (which, as used herein, is defined as being measured in a direction that is perpendicular to the fuse axis 34 and parallel to the second leg 68, i.e., vertically when viewing FIG. 2) is minimized because most or all of the height of the receiving terminal 24 is overlapped by the height of the fuse 26. Thus, the fuse 26 can be used in locations having a limited amount of available space in the height direction.

The principle and mode of operation of this invention have been explained and illustrated in its preferred embodiment. However, it must be understood that this invention may be practiced otherwise than as specifically explained and illustrated without departing from its spirit or scope.

What is claimed is:

1. A fuse terminal for use in a fuse assembly, the fuse terminal comprising:

a central body portion defining a terminal axis;

a first arm extending from the central body portion and defining an arm space that is located on a fuse side of the central body portion; and a connector portion extending from the central body portion and including a leg that extends on the fuse side of the central body portion, wherein the leg is planar and transverse to the terminal axis.

2. The fuse terminal of claim 1, wherein the central body portion is generally planar and extends in a direction generally perpendicular to the first arm.

3. The fuse terminal of claim 1, wherein the first arm has a curved shape.

4. The fuse terminal of claim 1, wherein the first arm has an outwardly-extending flange on a distal end.

5. The fuse terminal of claim 1, wherein the leg that extends on the fuse side of the central body portion is a second leg that extends from a first leg that extends from the central body portion.

6. The fuse terminal of claim 5, wherein the connector portion includes a width transition between the second leg and the central body portion.

7. The fuse terminal of claim 6, wherein the first leg is wider where it meets the second leg than it is where it meets the central body portion.

8. The fuse terminal of claim 2, further comprising a second arm that extends from the central body portion on the fuse side of the central body portion.

9. The fuse terminal of claim 8, wherein the first arm and the second arm define the arm space therebetween.

10. The fuse terminal of claim 9, wherein the leg that extends on the fuse side of the central body portion is a second leg that extends from a first leg that extends from the central body portion.

11. The fuse terminal of claim 10, wherein the connector portion includes a width transition between the second leg and the central body portion.

12. The fuse terminal of claim 11, wherein the first leg is wider where it meets the second leg than it is where it meets the central body portion.

13. A fuse terminal assembly comprising:

a fuse including a first end portion, a second end portion, and a central portion extending between the first end portion and the second end portion, the central portion extending along a fuse axis; and a fuse terminal including a central body portion that extends along a terminal axis that is generally parallel to the fuse axis, a first arm that extends from the central body portion and a second arm that extends from the central body portion, the first arm and the second arm defining an arm space therebetween that is located on a fuse side of the central body portion, and a connector portion that extends from the central body portion;

wherein the first arm and the second arm engage the first end portion of the fuse and retain the first end portion of the fuse against the central body portion; and the connector portion includes a leg that extends on the fuse side of the central body portion.

14. The fuse terminal assembly of claim 13, wherein the leg that extends on the fuse side of the central body portion is a second leg that extends from a first leg that extends from the central body portion generally parallel to the terminal axis.

15. The fuse terminal assembly of claim 14, wherein the central body portion is generally planar and the first arm and the second arm extend from opposed edges of the central body portion.

16. The fuse terminal assembly of claim 13, further comprising a fastener to retain the fuse terminal on the first end portion.

17. The fuse terminal assembly of claim 16, wherein the fastener is solder.

18. The fuse terminal assembly of claim 14, wherein the connector portion includes a width transition between the second leg and the central body portion.

19. The fuse terminal assembly of claim 18, wherein the first leg is wider where it meets the second leg than it is where it meets the central body portion.

20. The fuse terminal of claim 1, wherein the central body portion, the first arm, and the connector portion are formed from a single piece of material.

* * * * *